US005370583A

United States Patent [19]

Stewart

[11] Patent Number: 5,370,583

[45] Date of Patent: Dec. 6, 1994

[54] THRILL RIDE APPARATUS

[76] Inventor: Robert E. Stewart, 1411 N. Grant Ave., Indianapolis, Ind. 46201

[21] Appl. No.: 75,407

[22] Filed: Jun. 14, 1993

[51] Int. Cl.[5] ..... A63G 1/12

[52] U.S. Cl. ..... 472/18; 472/27; 472/47

[58] Field of Search ..... 472/18, 5, 27, 29, 31, 472/32, 33, 34, 39, 47, 19

[56] References Cited

U.S. PATENT DOCUMENTS

| | | | |
|---|---|---|---|
| 1,898,868 | 2/1933 | Cowie | 472/39 |
| 2,113,131 | 4/1938 | Eyerly | 472/39 |
| 2,357,481 | 7/1944 | Mallon | 472/27 |
| 2,468,893 | 5/1949 | Orance | 472/39 |
| 3,439,914 | 4/1969 | Willard | 472/18 |

*Primary Examiner*—Carl D. Friedman
*Assistant Examiner*—Kien Nguyen
*Attorney, Agent, or Firm*—Robert A. Spray

[57] ABSTRACT

A thrill-ride apparatus having as a basic concept the revolving of a rider station, whose support provides that the path of the ride will be along an inclined plane. The rider station is fixed to a support arm; and there is no counterbalance as to the weight of the support arm, rider's station, and the rider. The path of the rider is thus such that he must incrementally achieve not only the revolution with respect to the ground and the axis of the support structure, but by such oscillating incremental efforts achieve a raise from "bottom dead center" to "top dead center" as supported by the base of the apparatus.

12 Claims, 5 Drawing Sheets

THRILL RIDE APPARATUS

I. Field and background of the Invention

The present invention relates to a thrill-type riding apparatus by which the user can feel the thrill and excitement of a apparatus by which the user may have some control, and yet have the sensation of the control being taken from him as the ride progresses, as a sort of "backyard roller coaster" ride.

More particularly, the ride is such that it can be both play and exercise, with the pride of accomplishment in various aspects of the ride and the user's input of energy.

Still more particularly, the invention relates to a ride apparatus which can be of great excitement to the rider, and beneficial in other ways as indicated, and yet be considered generally economical in construction, such that it would not necessarily cost much more than a first-class swing apparatus for a homeowner's installation in a yard, considerably less than the cost of a special-effect ride apparatus considered typical of a carnival or commercial amusement park; and yet the concepts adapt themselves to being provided with various types of extras or control mechanisms, for special effect and/or special advantage.

II. The concepts of the Invention as briefly summarized

The invention and its concepts provide a thrill type riding apparatus by which the user can achieve the thrill and excitement, pride, and satisfaction of both strenuous play and exercise, with the pride of not only "mastering" it in terms of both physical energy and daring physical input, but overcoming the challenge and the surprise factors of the ride.

As a basic concept, the rider's station is fixed on a long support arm which is supported such that the path of the ride will be along an inclined plane; yet the construction is quite economical in giving a mixture of various types of ride thrills.

There is no counter-balance as to the weight of the support arm, rider's station, and the rider, giving special effects.

The path of the rider is thus such that he must incrementally achieve not only the revolution with respect to the ground and the axis of the support structure, but by oscillating incremental efforts achieve a raise from "bottom dead center" to "top dead center" as supported by the base of the apparatus; and the substantial yet intentional static and dynamic unbalance provides that once attaining that 180° goal, his movement suddenly changes from relatively slow oscillations requiring energy input increments, to a rushing and forward dropping stage, a free-falling sensation also with an outwardly increasing centrifugal force.

Various controls are optional extras, making the basic apparatus adaptable to have various and special self-propelling and self-controlling characteristics, of daring achievement, riding joy, ease of effort, safety, etc.

III. The invention's components and concepts, as being similar to those available in the prior art, except for the present concepts in particular Even in hindsight consideration of the present invention to determine its inventive and novel nature, it is not only conceded but emphasized that the prior art had details usable in this invention, but only if the prior art had had the guidance of the present concepts of the present invention.

That is, it is emphasized that the prior art had several particulars which individually and accumulatively show the non-obviousness of this combination invention:

a. The prior art has long had mechanisms of various types which required or used frame structures, including those of supporting rods and/or tubing fastened as by welding;

b. The prior art has long known of the principle of mechanical design of using earlier mechanisms as to their basic feature but modifying them to achieve different characteristics;

c. The prior art has long had and known of bearings of various types, sizes, and natures, which could be utilized as a basic part of rotational devices of a large size which could provide an amusement ride; and d. The prior art had long known of so-called "merry-go-rounds," and of their high appeal and commercial worthwhileness.

IV. More particulars of the prior art, as helping to show the invention's nature as inventive The prior art has even produced and used various inclined plane merry-go-round devices with various drive and control mechanisms; and the existence of such apparatus is not only conceded, it is emphasized; for as to the novelty here of the invention as considered as a whole, a contrast to the prior art helps show its contrast to the present concepts, and emphasizes the advantages and the inventive significance of the present concepts as are here shown, and the nature of the concepts and their results can perhaps be easier understood.

Even further as indicating the inventive nature of the present concepts is the result of a Preliminary Patentability Search made in the Search files of the U.S. Patent Office, after this invention was made, and during the course of considering the desire and likelihood of patent protection.

The Search produced the following, all U.S. Patents, except as noted. This investigation was conducted within Class 472, subclasses: 1*, 5, 14*, 18*, 25, 39, 47*, 118 and 119. (*=Examiners Foreign and Literature.) Class 472 had been Class 272; and many amusement device patents show Class 272 as their classification.

| U.S. Pat. No.: | Inventor: | Year: |
|---|---|---|
| 1,376,698 | Jay | 1921 |
| 1,461,075 | Tuso | 1923 |
| 1,670,882 | Eckberg | 1928 |
| 1,791,227 | Russell | 1931 |
| 1,898,868 | Cowie | 1933 |
| 2,841,395 | Walker | 1958 |
| 4,620,700 | Snarr | 1986 |
| 4,671,506 | Sutherland | 1987 |
| 4,896,878 | Greenwood | 1990 |
| 430,714 | British | 1935 |
| 2,421,474 | German | 1975 |

However, these references fail to show or suggest all of the details of the present concepts; and a realistic consideration of their several differences from the present concepts may more aptly be described as teaching away from the present invention's concepts, in contrast to suggesting them, even as to a hindsight attempt to perceive suggestions from a backword look into the prior art.

A basic difference from Greenwood, as to both construction and operativity, is fixed support of the seat or chair in the present invention, in contrast to any sort of swinging of the chair, such as in Greenwood which would cause a sort of lost motion effect which would seem to impede the attainment of momentum and elevation to build potential energy needed for the special thrill of rapid descent once top center was passed.

In the British Patent 430,714, the heavy counterweight "J" or other diametrically opposite features such as the opposite rider seem to substantially prevent the desired off-center gravity effect characteristic of the present invention but not possible with any relatively high or balancing counter-weight which seems characteristic of this British patent.

Walker has an inherent but here undesired balance, by his four circumferentially spaced stations.

Likewise as to counterbalance characteristics are Cowie and Tuso; and the German patent 2,421,474, has not only a counterbalance but non-fixed (swivel) seats.

Jay has only horizontal travel.

Snarr has odd and uncertain kinematic characteristics.

Russell, Eckberg, and Sutherland have inclination and solid or fixed seat, but give only a possibility of dynamic unbalance, i.e., only if the opposing seats are unoccupied.

Accordingly, although various concepts of inclined plane prior art are conceded and emphasized to have been known and used in the prior art, nevertheless, the prior art not having had the particular combination of concepts and details as here presented, and shown as a novel combination for special thrill-ride effects, different from the prior art and its suggestions, even only a fair amount of realistic humility, to avoid consideration of this invention improperly by hindsight, requires the concepts and achievement here to be realistically viewed as a novel combination, inventive in nature. And especially in this a realistic consideration when viewed from the position of a person of ordinary skill in this art at the time of this invention, and without trying to reconstruct this invention from the prior art without use of hindsight toward particulars not suggested by the prior art of all relevant fields.

V. Brief description of the Drawings

The above description of the novel and advantageous invention is of somewhat introductory and generalized form. More particular details, concepts, and features are set forth in the following and more detailed description of an illustrative embodiment, taken in conjunction with the accompanying drawings which are of somewhat schematic and diagrammatic nature, for showing the inventive concepts:

Figure 1:
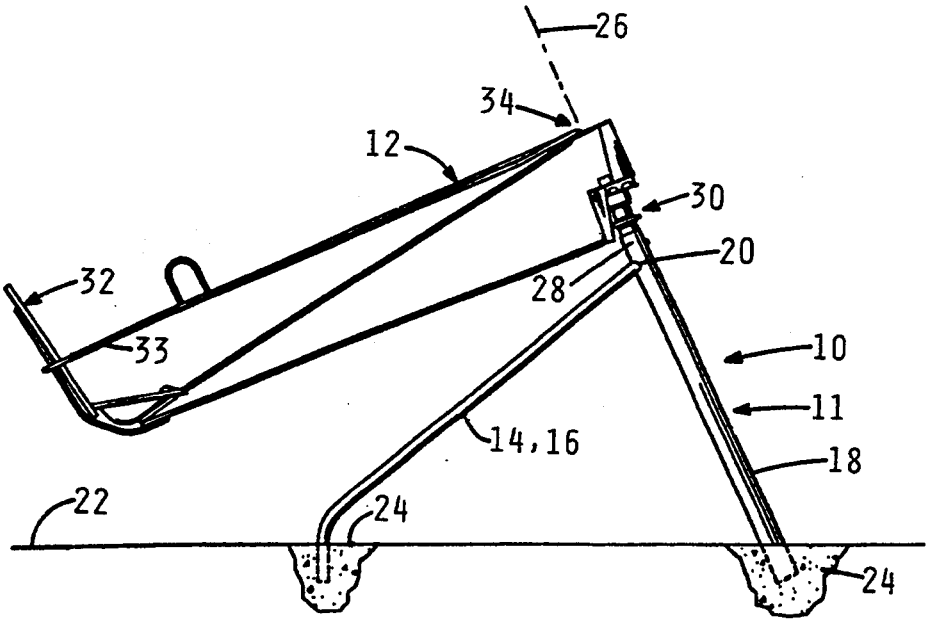
FIG. 1 is an elevational view of the thrill ride apparatus of the present invention, the support arm and the rider's seat being at a position of its trajectory in which the rider's seat is closest to the ground, as would be the position when the rider is climbing onto the apparatus and also a position at the "bottom dead center" of the rider's seat during the maneuvering of the seat during a ride.
Figure 2:
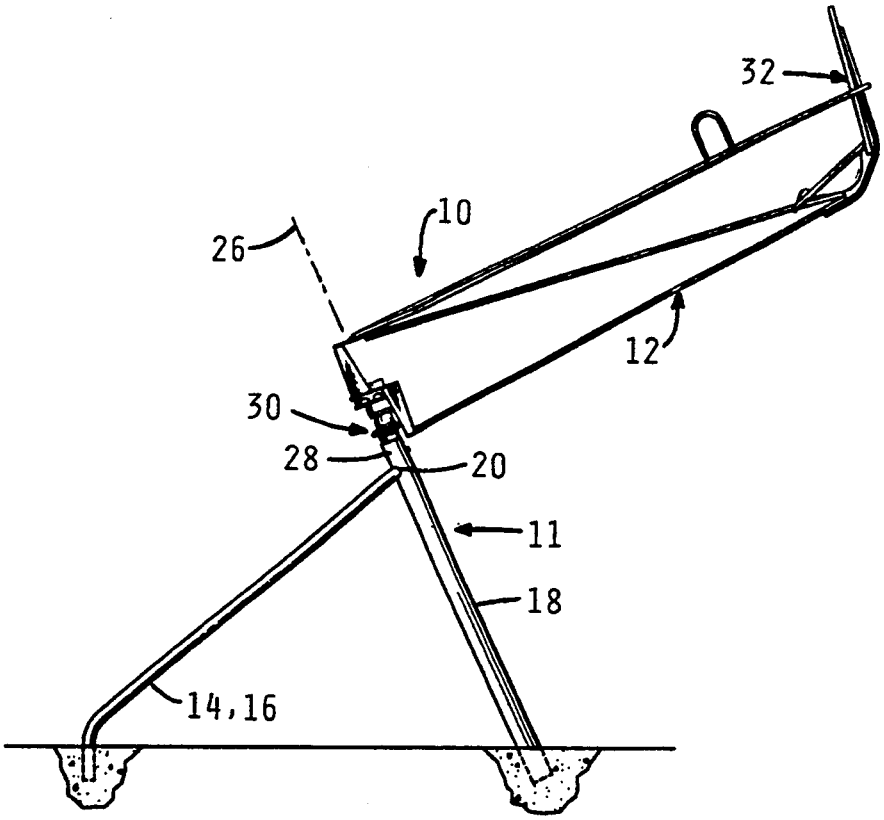
FIG. 2 is an elevational view similar to FIG. 1, but illustrating the support arm and the rider's seat in a "top dead center" position during maneuvering of the apparatus during the ride.
Figure 3:
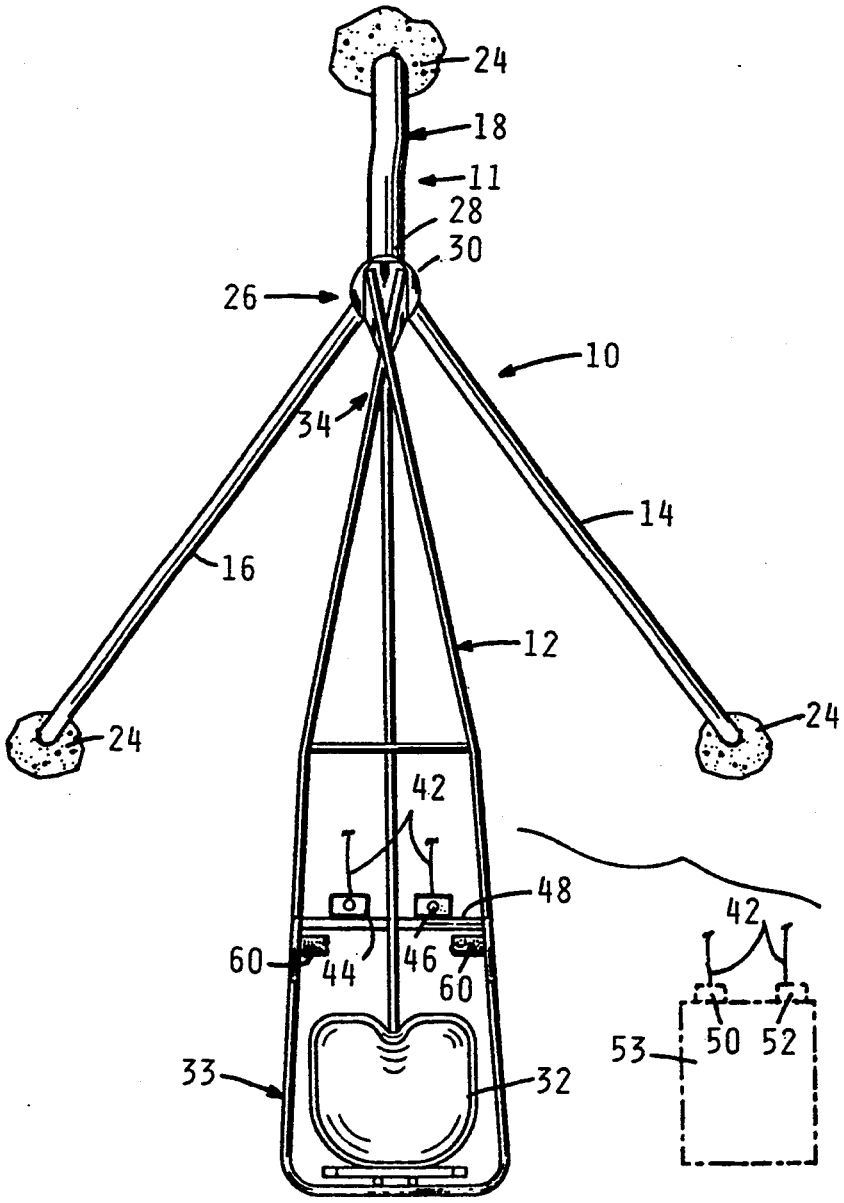
FIG. 3 is a top or plan view of the apparatus of FIGS. 1 and 2, as the support arm and the rider's seat would be in a "bottom dead center" position.
Figure 4:
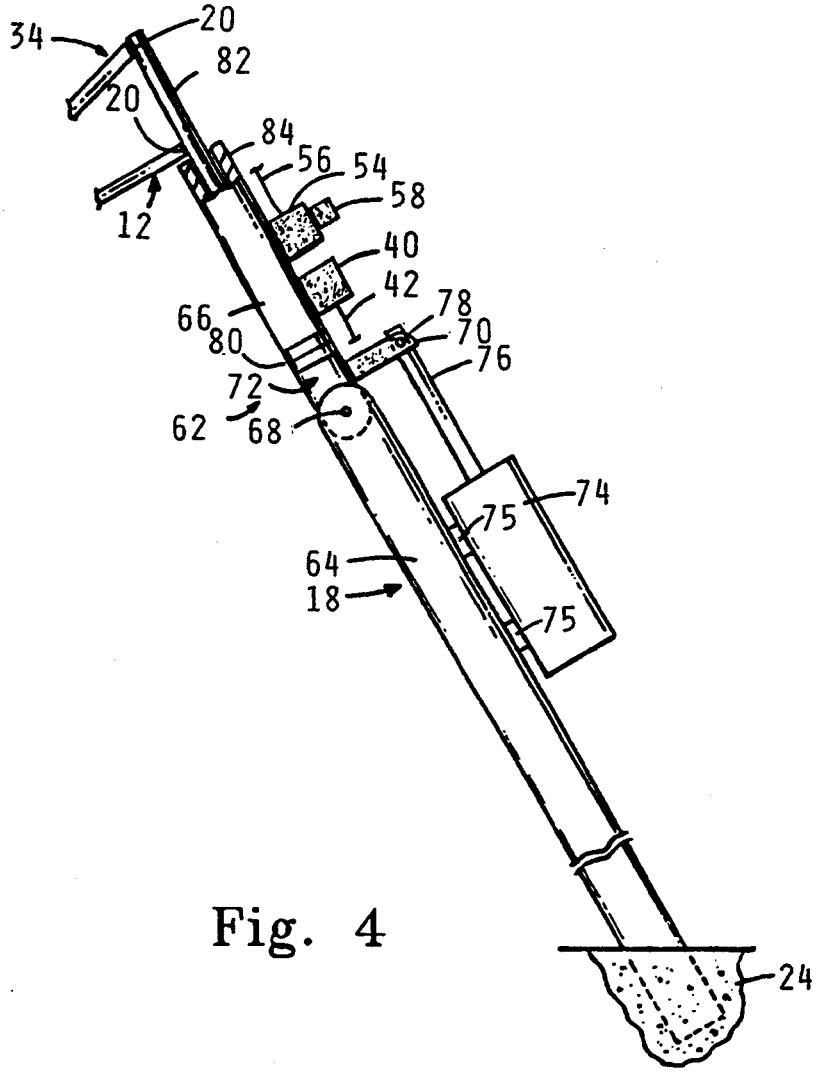
Figure 5:
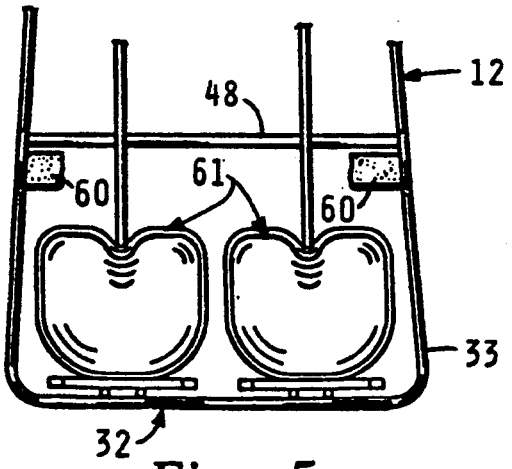

FIG. 4 is a schematic view of the main support leg of the apparatus, illustrating schematically the use of various components not shown in the pictorial views of FIGS. 1–3, and particularly illustrating the versatility and adaptability of the basic apparatus to various situations of use, generally although not necessarily limited to the expected use being that of a "backyard" or non-commercial installation or use, although with sometime an attendant to monitor the use by children; and FIG. 5 is a detail sketch, in plan view, illustrating a construction providing a two-seat or two-station rider provision.

VI. Detailed description of an illustrative embodiment of the Invention

As the invention and its basic concepts are illustrated in the accompanying drawings, the present invention provides a novel and advantageous "thrill ride" apparatus 10 which comprises a combination of several elements whose most obvious components are a ground-supported base 11 and rotatively a movable support assembly 12.

The base 11 is shown as an assembly of a three legs 14, 16, and 18, welded as at welds 20 into a sturdy tripod base arrangement, and very sturdily and stably given ample support by the ground 22 by concrete pads 24.

The legs 14 and 16 in the form shown are brace-type leg members; and they extend as an assembly in the same direction as is the "bottom point" described below as to the motion of the support assembly 12.

The main leg 18 is a multi-purpose member, providing both a sturdy support leg for the overall apparatus 10 and a mount or carrier of mechanism described below which provides the support assembly 12.

As mentioned more fully herein, the main leg 18 carries the support assembly 12 mechanism in a manner by which special rotation of the support assembly 12 is governed; and thus it is to be especially noted that the main leg 18 is shown as having its axis 26 significantly offset from the vertical, preferably between 20° to 35°.

The base structure 11 at its top 28, which in the form shown is itself the upper end of the main leg 18, carries a body member means shown as a bearing assembly 30 for the rotatable and revolving movement of the support assembly 12, described herein, as is supported by the bearing assembly 30.

Shown schematically for the bearing assembly 30 is a bearing modified from a truck bearing, in which the axle portion is supportively inserted into the upper end 28 of the base 11's main leg 18; and revolvable frame-connecting portions of the bearing are shown merely diagrammatically, as upper and lower trapezoid-shaped connector pieces which respectively are connected to upper and lower portion of the inner portion of the support assembly 12. (The particulars of the bearing 30 are not a part of the present invention; but it is to be noted of course that the bearing 30 should be quite sturdy, substantially friction-free, and sturdily assembled to the base 11.)

The support assembly 12, shown constructed generally of welded tubes or rods, provides a carrier frame for the fixed rider's station 32 shown in FIGS. 1–3 as a fixed chair seat 32; and it is by the revolving or rotational movement of the support assembly frame 12 that the rider achieves the motion of the ride, and achieves its factors of energy effect, thrill, challenge, and interest, etc., as described herein.

More particularly in the form as shown, the support assembly 12 is provided adjacent its outer end 33 with the fixed rider station 32; and as shown, the rider station 32 is such that when the rider is riding the apparatus he or she is facing toward the axis 26 of revolution of the support assembly 12.

The fixed nature of the rider station 32, being fixed with respect to the support assembly 12, provides that the rider station 32 stays oriented with respect to the support assembly 12 such that, when occupying the rider station 32 for riding the apparatus, the rider will be continually operatively facing toward the axis of revolution 26 of the support assembly 12, even though the support assembly 12 and the rider station 32 are changing orientation with respect to the ground during a riding of the apparatus.

As shown, the support means 12 is supported by the bearing 30 atop the base 11, and the overall support is such that the support of the support assembly 12 at its inner end 34 provides for movement having basic characteristics: revolving movement of the support assembly 12 with respect to the base 11; revolving movement of the support assembly 12 about the axis 26 which is displaced from the vertical; and movement, of the support assembly 12 throughout about 180° of the movement of the rider station 32, such that the movement of the rider station 32 is significantly inclined upwardly, in a kinematic correlation to its revolving movement about the axis 26.

Moreover, as a basic characteristic of the apparatus 10 and its operativity, during at least about 180° revolving movement of the rider station 32 from a "bottom dead center" (FIG. 1) position, the support assembly 12 (including the rider station 32) is free from any significant counterbalancing effect which would significantly lessen the work effort occasioned by the raise in elevation of the rider station 32 as is incidental to the revolving or arcuate movement of the support assembly 12 throughout that movement in either direction away from its FIG. 1 position.

Both the concepts and the construction provide both a substantial static unbalance and a substantial dynamic unbalance.

The physical operativity of the apparatus 10 is such that a rider positioned at the rider station 32, either with or without assistance from a companion or other attendant standing on the ground, and while the rider is facing the axis of rotation 26, the rider must exert a sort of "pumping" body-movement action (and/or some pushing his feet onto the ground) sufficient to impart the beginning arc of a revolving movement of the support assembly 12 and,the rider's station 32.

In the use of the apparatus 10 as shown, the movement from FIG. 1 is circular about the axis 26, although it can be initially, and at the rider's option, in either circumferential direction, i.e., clockwise or counterclockwise with respect to the ground and to the base 11 and axis 26 as shown in the plan view of FIG. 3.

The rider's initial effort and energy will not be expectedly sufficient to rotate the support assembly 12 (and rider's station 32) more than a relatively few degrees of arc; for the support by the bearing 30 carries the support assembly 12 for-movement along an inclined plane due to the off-vertical disposition of the axis 26, and thus the arc movement of the support frame 12 inherently includes some-elevational raise of the support assembly 12 and the rider's station 32, and its rider.

That raise of course takes energy input, by a change of that dynamic energy to potential energy due to the raise in elevation, even though the bearing 30 is desirably of a relatively friction-free nature, and even though at and adjacent both sides of the "beginning" or bottom dead center (FIG. 1) position (and at and adjacent both sides of the top dead center (FIG. 2) position), the change in elevation is very small per degree of rotational arc movement of the support assembly 12 and ride station.

At the end of whatever was achieved as the incremental arcuate travel of that initial effort, the friction-free nature of the bearing 30, as the support assembly 12 is attracted by gravity, permits the support 12 to then "fall back," i.e., to reverse its arcuate direction, returning, and by its momentum going past the "bottom point" or "low dead center" position shown in FIG. 1.

Subsequently, assuming there is more energy imparted in that reverse direction, by the rider and/or by the attendant, that reverse motion will achieve an arcuate movement and elevational raise correspondingly more than had been achieved by the initial forward-direction effort.

For reason of relaxing or whatever other reason, the rider and/or attendant may not always choose to impart energy on every increment of forward/reverse swing increments; but, with an assumption of at least occasional energy inputs, as such forward and reverse oscillations continue as the ride progresses, after several less than 180° oscillations the support assembly 12 and of course the rider's station 32, and the rider, will ultimately achieve a "top dead center" position as illustrated in FIG. 2.

Once achieving the position of "top dead center" (or even within a few degrees of it), the momentum of the revolving support assembly 12 and the rider's station 32 carries them instantly over, i.e., onward past that FIG. 2 top position; and with a startling and exciting change of effect, gravity now acts to cause a continuance of the motion which reached that top (FIG. 2) position, the motion now finishing a full 360° rotation on that particular occasion, in contrast to all oscillations theretofore having been at the most only that approaching 180°.

The intentional and advantageous lack of counterbalancing of the support arm assembly 12 is also to be noted with respect to the travel not only which includes a raise in elevation of the support assembly 12 and rider's station 32, but also as to a travel which includes a lowering of them. That is, the arrangement is such that there is intentionally no counterbalancing of the support arm assembly 12 which would affect the movement past the 180° (FIG. 2) position of the rider's station 32 and its support assembly 12.

More particularly, the inclined support by the bearing 30 and base 11 also includes the movement of the rider's station 32 after its movement of about 180° to also be free from any significant counterbalancing effects which would significantly lessen the gravitational effect throughout the subsequent 180° movement of the support assembly 12 and rider, as the rider's station 32 is lowered in elevation.

The sudden "free falling"or dropping effect, once 180° has been reached, is not only alarmingly different from all the relatively slow and energy-inputting incremental oscillatory movements prior to 180°, but that increasing falling (once past 180°) gives an increasing centrifugal alarm to the rider until and even after the bottom dead center (FIG. 1) position is reached.

The bearing 30 is desirably of such a friction-free nature that once the rider's station 32 is past top dead center (FIG. 2), the rider's station will continue past bottom dead center (FIG. 1) and swing again on up to top dead center without any or much addition of energy.

The apparatus also accommodates various controls and other components which add to the versatility, enjoyment and interest, of the overall mechanism 10. One such advantageous additive is the provision of a motor means 40 which is schematically shown as powered by circuitry 42 and as controlled by an "on" control switch 44 and an "off" control switch 46, shown as mounted on a crossbar 48 at or operatively adjacent the rider's station 32. Desirably, similar controls 50 and 52, respectively, are provided at an attendant's station 53, as generally diagramatically illustrated in FIG. 3, all providing power to the support assembly 12 at the option of the rider.

The motor 40 is desirably of low energy output, and merely in a nature of a power boost mechanism, assuring that only a pulse or small increment of energy is imparted to this system during any single oscillation of the support arm 12.

Moreover, the motor 40 is desirably in the nature of one having a neutral or free-coasting effect except when intentionally energized.

Desirably, also as shown in FIG. 4, brake means 54 are provided, controllable by either the rider or an associated attendant, as shown schematically and by circuitry 56 in FIG. 4.

Also, desirably a governor 58 is provided which limits the speed of the support assembly 12.

Other additions adding to the overall apparatus 10 are a seat belt 60, and an assembly having a dual-seat rider's station, as schematically indicated in FIG. 5, as shown at 61.

FIG. 4 also illustrates the concepts of a mechanism 62 by which the inclination of the travel of the support assembly 12 may be varied, although preferably within the limits of 20° to 35° of slope, i.e., with respect to the horizontal.

More particularly, FIG. 4 illustrates the provision of the main leg 18 shown as being formed of two sections, namely a lower or ground-engaging section 64 and an upper section 66, shown pinned together by pin 68; and from the leg-section 66 there is an arm 70 extending outwardly, making the components 66 and 70 a sort of bellcrank component 72 by which the inclination of the plane of travel of the support structure 12 may be varied i.e., by power from a hydraulic cylinder 74 mounted by brackets 75 to the main leg 18's lower section 64, and having a power piston 76 shown pinned at 78 to the bellcrank arm 70.

In the form shown, the upper support arm 66 is shown as carrying a bearing device 80, and the bearing 80 is shown carrying a central power or drive shaft 82, shown axially carried within a support tube 84, which as shown supports the support structure 12 for its inclined-plane movement and for power-drive or power-brake control as described.

As thus diagrammatically shown, hydraulic power to the piston 76 of the hydraulic cylinder 74 acts through the pin 78 to rotate the bellcrank 72, thus rotating the power-tube 82 about pin 68, changing the slope of movement of the support assembly 12 and rider's station 32.

VII. Conclusion and Summary, as inventive combination

It is thus seen that a thriller ride combination, constructed and used according to the inventive concepts herein set forth, provides novel concepts of a desirable and advantageous device, yielding the advantages of an overall combination of a ride device which in overall combination is conceptually different from the prior art even though a basic concept of such rides is known already; yet significantly this particular combination of prior art in the field of such rides and similar mechanisms has not been suggested by the prior art, this achievement being a substantial and advantageous departure from prior art, even though the prior art shows attempts at variations as to inclined plane rides for many years. And particularly is the overall difference from the prior art significant when the non-obviousness is viewed by a consideration of the subject matter as a whole, as integrally incorporating a combination of features as different from the prior art, in contrast to merely those details of novelty themselves, and further in view of the prior art teaching away from the particular and inter-related concepts and features of the present invention as a novel combination.

In summary as to the nature of these advantageous concepts, their inventiveness is shown by novel features of concept and construction shown here in novel and advantageous combination, not only being different from all the prior art known, but because the achievement is not what is or has been suggested to those of ordinary skill in the art, especially realistically considering this as comprising components which individually are similar in nature to what is well known to most persons skilled in this art for many years. No prior art has suggested the modifications of any other prior art to achieve the novel concepts here achieved, with the various features providing their own functions in the overall combination.

Accordingly, it will thus be seen from the foregoing description of the invention according to this illustrative embodiment, considered with the accompanying drawings, that the present invention provides new and useful concepts of a novel and advantageous ride mechanism device having and yielding desired advantages and characteristics in formation and use, and accomplishing the intended objects, including those hereinbefore pointed out and others which are inherent in the invention as a novel apparatus combination.

Modifications and variations may be effected without departing from the scope of the novel concepts of the invention; accordingly, the invention is not limited to the specific embodiment; or form or arrangement of parts herein described or shown.

I claim:

1. A thrill ride apparatus, comprising, in combination:

a support assembly;

a ground-supported base including leg means which movably support the support assembly for movement about an axis of revolution displaced from the vertical, and as further set forth below;

the support assembly being provided adjacent one end with a fixed-nature rider station for a rider's riding of the apparatus;

and the support assembly being provided to be such that the weight of it, throughout the distance between the axis of revolution to and including the rider station, is very significantly more than the weight of any portion of the support assembly which is on the side of the axis of revolution opposite that of the rider station;

the fixed nature of the rider station being such that the rider station is fixed with respect to the support assembly, and the rider station is oriented with respect to the support assembly, such that, when occupying the rider station for riding the apparatus, the rider will be continually operatively facing toward the axis of revolution of the support assembly, even though the support assembly and the rider station are changing orientation with respect to the ground during a riding of the apparatus;

support means provided to be an upper head portion of and supported by the ground-supported base, and comprising a body member means movably and supportively providing a supporting body for the support assembly and a supporting axis of revolution of and for the support assembly at the support assembly's other end, for movement of the support assembly characterized operatively by at least both of the following, in addition to the revolving movement of the support assembly being about an axis which is displaced from the vertical:

(a) revolving movement of the support assembly with respect to the ground-supported base and to the ground, and (b) the movement, of the support assembly, throughout about 180° of the movement of the rider station, is such that the movement of the rider station is significantly upwardly in kinematic correlation to the rider station's revolving movement about the said axis, and in which apparatus, during at least about 180° revolving movement of the rider station, the support assembly is free from any significant counterbalancing or counterbalancing means or moment with respect to the axis of revolution which would significantly lessen the work effort occasioned by the raise in elevation of the rider station as is incidental to the revolving of the support assembly throughout that movement.

2. The invention as set forth in claim 1, in a combination in which the provision of weight of the support assembly, throughout the distance between the axis of revolution to and including the rider station, being very significantly more than the weight of any portion of the support assembly opposite that of the rider station, provides that movement provided by the support means also includes the movement of the rider station after its said movement of about 180° to also be free from any significant counterbalancing or counterbalancing means or moment with respect to the axis of revolution which would significantly lessen the gravitational effect throughout the subsequent 180° movement of the rider station as the rider station is lowered in elevation.

3. The invention as set forth in claim 2, in a combination in which there are provided motor means for providing power to the support assembly at the option of the rider.

4. The invention as set forth in claim 2, in a combination in which brake means are provided, controllable by either the rider or an associated attendant.

5. The invention as set forth in claim 2, in a combination in which a governor is provided which limits the speed of the support assembly.

6. The invention as set forth in claim 2, in which power means are provided for adjusting the axis of movement of the support assembly.

7. The invention as set forth in claim 2, in a combination in which the rider station is provided to accommodate a pair of riders.

8. The invention as set forth in claim 1, in a combination in which there are provided motor means for providing power to the support assembly at the option of the rider.

9. The invention as set forth in claim 1, in a combination in which brake means are provided, controllable by either the rider or an associated attendant.

10. The invention as set forth in claim 1, in a combination in which a governor is provided which limits the speed of the support assembly.

11. The invention as set forth in claim 1, in which power means are provided for adjusting the axis of movement of the support assembly.

12. The invention as set forth in claim 1, in a combination in which the rider station is provided to accommodate a pair of riders.

* * * * *